US008562318B1

(12) United States Patent
Gottfried et al.

(10) Patent No.: US 8,562,318 B1
(45) Date of Patent: Oct. 22, 2013

(54) MULTIPHASE PUMP WITH HIGH COMPRESSION RATIO

(75) Inventors: Kristjan Gottfried, Calgary (CA); Alejandro Juan, Calgary (CA); Curtis Patterson, Calgary (CA)

(73) Assignee: Exponential Technologies, Inc., Calgary, Alberta (CA)

( * ) Notice: Subject to any disclaimer, the term of this patent is extended or adjusted under 35 U.S.C. 154(b) by 483 days.

(21) Appl. No.: 12/853,200

(22) Filed: Aug. 9, 2010

Related U.S. Application Data

(60) Provisional application No. 61/235,640, filed on Aug. 20, 2009.

(51) Int. Cl.

| | |
|---|---|
| ***F01C 1/08*** | (2006.01) |
| ***F01C 1/24*** | (2006.01) |
| ***F01C 21/00*** | (2006.01) |
| ***F03C 2/00*** | (2006.01) |
| ***F04C 21/00*** | (2006.01) |

(52) U.S. Cl.
USPC ..... 418/195; 418/186

(58) Field of Classification Search
USPC ..... 418/151, 195, 75, 78; 415/170.1; 464/139, 149, 157, 73
See application file for complete search history.

(56) References Cited

U.S. PATENT DOCUMENTS

| | | | |
|---|---|---|---|
| 32,372 | A | 5/1861 | Jones |
| 351,129 | A | 10/1886 | Salomo |
| 914,155 | A | 3/1909 | Mills et al. |
| 991,576 | A | 5/1911 | White |
| 1,379,653 | A | 5/1921 | Shoemaker |
| 2,101,051 | A | 12/1937 | Cuny |
| 2,101,428 | A | 12/1937 | Cuny |
| 2,242,058 | A | 5/1941 | Cuny |
| 2,431,817 | A | 12/1947 | Mann |
| 3,101,700 | A | 8/1963 | Bowdish |

(Continued)

FOREIGN PATENT DOCUMENTS

| | | |
|---|---|---|
| CA | 2069607 | 11/1993 |
| DE | 1551081 | 4/1970 |

(Continued)

OTHER PUBLICATIONS

Wankel, Felix, Rotary Piston Machines, Jan. 1, 1965.

(Continued)

*Primary Examiner* — Kenneth Bomberg
*Assistant Examiner* — Deming Wan
(74) *Attorney, Agent, or Firm* — Dwayne E. Rogge; Schacht Law Office, Inc.

(57) ABSTRACT

This disclosure relates to a new multiphase pump with low recirculated volume. This device discloses novel inlet/outlet porting. One of the disclosed improvements is to port the inlet and outlet through the back of the rotors. In the model shown there is only one lobe on the first rotor, and two lobes on the second rotor. The double lobe rotor has the ports provided thru the back, in the lowest point on the buckets between the lobes. If there were more lobes on the two rotors, then the ports would normally be provided in the rotor with the higher number of lobes, preferably in the lowest point on each bucket. The single lobe rotor shown has voids formed in the outer circumference in order to balance the rotor—however, any rotor with more than one lobe may be naturally balanced and these holes may be unnecessary.

5 Claims, 8 Drawing Sheets

(56) References Cited

U.S. PATENT DOCUMENTS

| | | | | | |
|---|---|---|---|---|---|
| 3,106,912 | A | * | 10/1963 | Kahlert | 418/195 |
| 3,156,222 | A | | 11/1964 | Miller, Jr. | |
| 3,236,186 | A | * | 2/1966 | Wildhaber | 418/193 |
| 3,272,130 | A | | 11/1966 | Mosbacher | |
| 3,653,790 | A | * | 4/1972 | Ifield | 418/73 |
| 3,816,038 | A | | 6/1974 | Berry | |
| 3,816,039 | A | | 6/1974 | Berry | |
| 3,856,440 | A | | 12/1974 | Wildhaber | |
| D263,970 | S | | 4/1982 | Wiholm | |
| 4,702,206 | A | | 10/1987 | Harries | |
| 4,721,445 | A | * | 1/1988 | Hoffmann | 418/61.3 |
| 5,056,314 | A | | 10/1991 | Paul et al. | |
| 5,513,969 | A | * | 5/1996 | Arnold | 418/195 |
| 5,755,196 | A | | 5/1998 | Klassen | |
| 6,032,636 | A | * | 3/2000 | Kajino | 123/230 |
| 6,036,463 | A | | 3/2000 | Klassen | |
| 6,146,120 | A | * | 11/2000 | Harms | 418/61.2 |
| 6,497,564 | B2 | * | 12/2002 | Klassen | 418/195 |
| 6,769,889 | B1 | * | 8/2004 | Maier et al. | 418/171 |
| 6,887,057 | B2 | * | 5/2005 | Klassen | 418/195 |
| 6,923,055 | B2 | * | 8/2005 | Klassen | 73/265 |
| 2002/0037228 | A1 | * | 3/2002 | Arnold | 418/195 |
| 2011/0311351 | A1 | * | 12/2011 | Patterson et al. | 415/170.1 |

FOREIGN PATENT DOCUMENTS

| | | |
|---|---|---|
| DE | 3221994 | 12/1983 |
| FR | 916277 | 8/1946 |
| GB | 5686 | 0/1902 |
| GB | 805370 | 12/1958 |
| GB | 1099085 | 1/1968 |
| IT | 268459 | 1/1933 |
| JP | 4329764 | 12/1943 |
| JP | 5572683 | 5/1980 |
| WO | 9961753 | 12/1999 |

OTHER PUBLICATIONS

George, Michael, Granco Positive Displacement Pump, Plant Engineering Magazine, Dec. 10, 1981.

* cited by examiner

MULTIPHASE PUMP WITH HIGH COMPRESSION RATIO

RELATED APPLICATIONS

This application claims priority benefit of U.S. Ser. No. 61/235,640, filed Aug. 20, 2009 and incorporated herein by reference.

BACKGROUND OF THE DISCLOSURE a) Field of the Disclosure

This disclosure relates to the field of multiphase pumps, in some embodiments pumps with low recirculated volume. This device is similar to a standard "wave rotor" pump/compressor, but with some key changes to the inlet/outlet porting to allow for multiphase and to increase the compression ratio.

SUMMARY OF THE DISCLOSURE

Disclosed herein is a rotary pump comprising several interoperating components including: a first rotor comprising a back side, and a front side comprising at least one lobe working in conjunction with a second rotor in comprising a back side, and a front side comprising at least two buckets. In one form, the front side of the first rotor is in contact with the front side of the second rotor and operatively configure to rotate relative thereto. A housing encompassing the first and second rotors is disclosed as well as a shaft operatively configured to rotate relative to the housing. The pump utilizes a first port extending from the front side of the second rotor at each bucket to the back side of the second rotor; and in one form, at least two primary channels provided adjacent the back side of the second rotor and in fluid communication with the first port at specific regions as the second rotor rotates relative to the housing. The pump also utilizes an inlet port provided in the housing, in fluid communication with one of the primary channels; and an outlet port provided in the housing, in fluid communication with one of the primary channels other than the primary channel in fluid communication with the inlet port.

The rotary pump described above may also incorporate a secondary port extending from the front side of the second rotor at each bucket toward the back side of the second rotor. Where the secondary port is angularly and radially offset from the first port in communication with the associated bucket. A secondary channel may be provided adjacent the back side of the second rotor and in fluid communication with the secondary port at specific regions as the second rotor rotates relative to the housing. In one form, the secondary channel is in fluid communication with the outlet port.

The rotary pump may also be configured wherein at least one of the rotors comprises at least one surface defining a void formed in the outer circumference operatively configured to balance the rotor and wherein the surface defining the void is not in fluid communication with the lobes at any point in the rotation of the rotary pump.

The rotary pump as described above rotates in that the first rotor rotates in a first direction at a first rotational speed, and the second rotor rotates in the first direction at a second rotational speed which is different than the first rotational speed. The rotors may rotate such that the difference between the speed of first rotor relative to the second rotor is n1/n2 where n1 is the number of lobes on the first rotor and is the number of lobes on the second rotor.

DESCRIPTION OF THE PREFERRED EMBODIMENTS

Figure 1:
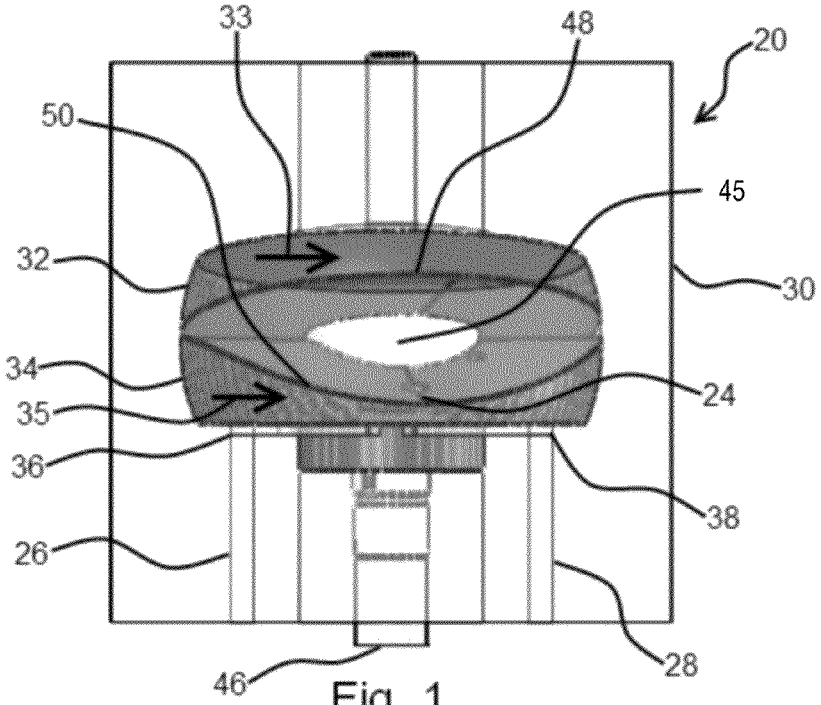
FIG. 1 is a front view of one embodiment of the disclosure in a first position with a portion of the housing removed to show the rotors and shaft.

This disclosure relates to a new multiphase pump 20 with low recirculated volume. This device is similar to a standard "wave rotor" pump/compressor, but with some key changes to the inlet/outlet porting to allow for multiphase and to increase the compression ratio.

The key to the disclosed improvements in one form is to port the inlet 22 and outlet 24 out of the back of one of the rotors as shown. The model shown is a relatively simple design as there is only one lobe on the first rotor 32, and two lobes on the second rotor 34. The double lobe second rotor 34 as shown has the ports 22/24 drilled thru the back, in the lowest point on the buckets between the lobes. If there were more lobes on the two rotors, then the ports would normally be provided in the rotor with the higher number of lobes, preferably in the lowest point on each bucket. The single lobe rotor 32 shown has voids 40 formed in the outer circumference in order to balance the rotor—however, any rotor with more than one lobe may be naturally balanced and these holes may be unnecessary. The first rotor 32 rotates in a first direction 33, while the second rotor 34 rotates in a second direction 35, but at a different speed than the first rotor 32. In one form, there is a difference in speed of each rotor of n1/n2 where n1 is the number of lobes on the first rotor 32 and n2 is the number of lobes on the second rotor 34. In one embodiment, one rotor will have exactly one more lobe than the other rotor, for example, 1 lobe to 2 lobes, or 6 lobes to 7 lobes.

The ports 22/24 in the back of the rotor 34 align radially outward from the center of rotation of the pump 20 with a pair of channels 36 and 38 cut into the housing 30. Each primary channel 36/38 is cut at the same radial distance from the center of rotation of the rotor as the rotor ports 22/24, and spans substantially 180 degrees minus the width of a rotor port as shown at locations 78 and 80. One of these channels is coupled to the inlet 26, and the other to the outlet 28 in the course of a rotation. The outer spherical surface of the two rotors in one form is preferably completely sealed, with no openings, unlike previous designs which had the inlet and outlet openings in this area. In this way, each chamber between the respective lobes of each rotor is either open to the inlet 26 or the outlet 28 at all times, except for a moment during rotation where the ports 22 and 24 align with the areas 78 and 80. As a result, it does not matter whether the contents of each cavity (bucket) are compressible or incompressible fluids—both types of fluid will simply be completely forced out of each cavity and into the outlet primary channel 38.

Also shown on this model is a small relief channel 42 linked to the outlet primary channel 38. This relief channel 42 connects to a relief port 44 in the back of the rotor 34 that aligns with the small "recirculated volume" that forms with each compression stroke. This port 44 simply allows this recirculated volume region to collapse fully without "locking" the mechanism—that is to say, if said region was filled with a fluid, and did not have the relief channel 42 present during the compression stroke, the mechanism would be difficult to turn due to the resistance of the fluid to compression. This relief channel 42 is shown here, because this rotor surface design in one form has inherent recirculated volume.

In order to maximize efficiency, small check valves can be inserted in the voids 22/24/44/56 in the back of the rotor. These check valves will prevent backflow of fluid each time the void moves from the inlet channel to the outlet channel.

This design also opens up new avenues for sealing—an apex and side seal design similar to Wankel rotary engines can be used, with the apex seal along the high point of the lobe in the single lobe rotor, and side seals all around the circumference where the lobe surfaces meet the spherical outer diameter. These types of seals were possible before, but the very small number of lobes required for this new design makes them much more practical. These types of seals should greatly increase compression efficiency. It is possible to place positive contact seals around the ports 38 and 36 which could be similar in nature to the Wankel side seals, or could take some other form FIGS. 1-3, 4-6, 7-9, 10-12, and 13-15 show a series of rotary positions or stages of the first rotor 32 rotating relative to the second rotor 34 which is normally attached to the shaft 46.

Figure 2:
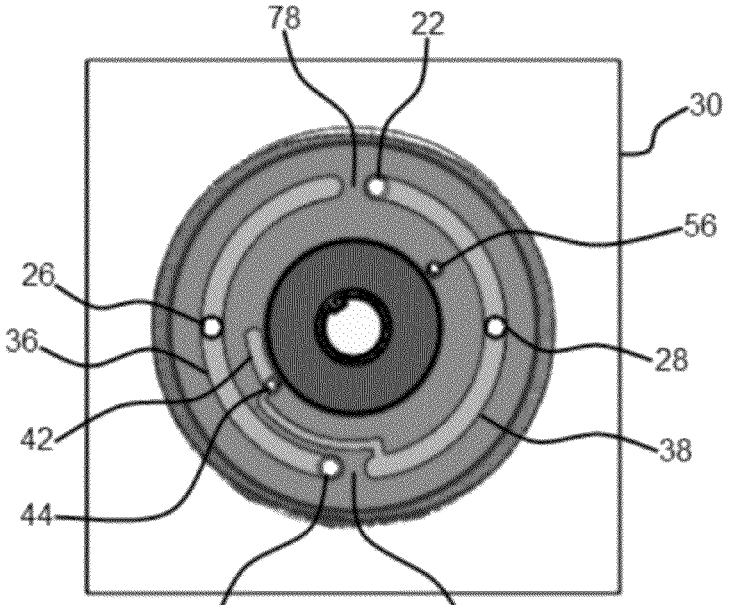
FIG. 2 is a top cutaway view of the embodiment shown in FIG. 1.
Figure 3:
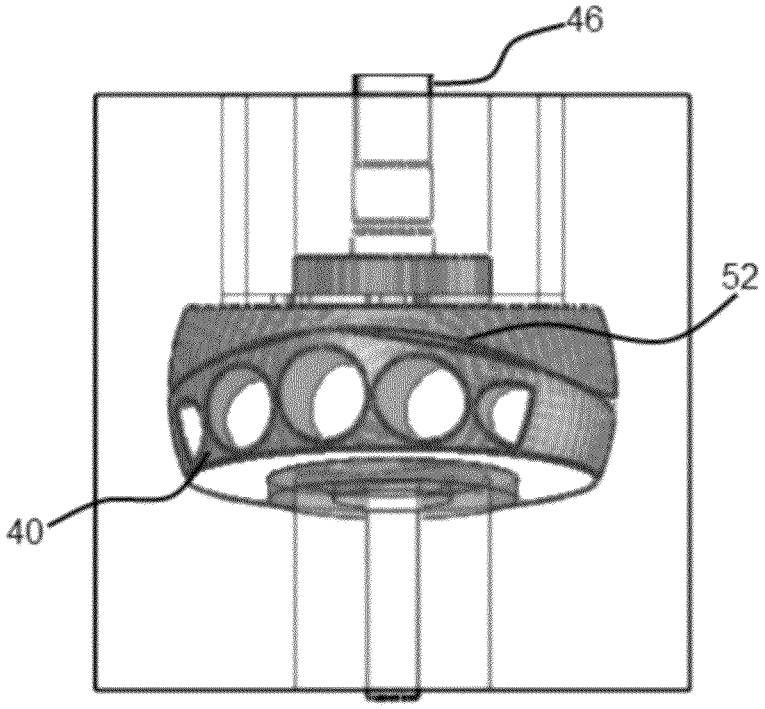
FIG. 3 is a rear view of the embodiment shown in FIG. 1 flipped top to bottom to show the opposing side.

As can be seen in FIGS. 1-3, the area 45 shows a first stage of the pump rotation. At this first stage, the region above the port 24 between the buckets 48 and 50 is at it's maximum volume as the fluid therein begins to compress, as the rotors reposition. On the opposite side of the pump, the volume of the area at 52 begins to expand, allowing fluid to enter the pump. FIG. 2 shows the port 56 not connected to any channel, but the port 44 on the back of the rotor is connected to the "recirculated volume" secondary channel 42 as previously described. Also, in this stage, the port 24 is connected to the primary channel 36 as the adjacent space 52 begins to expand.

Figure 4:
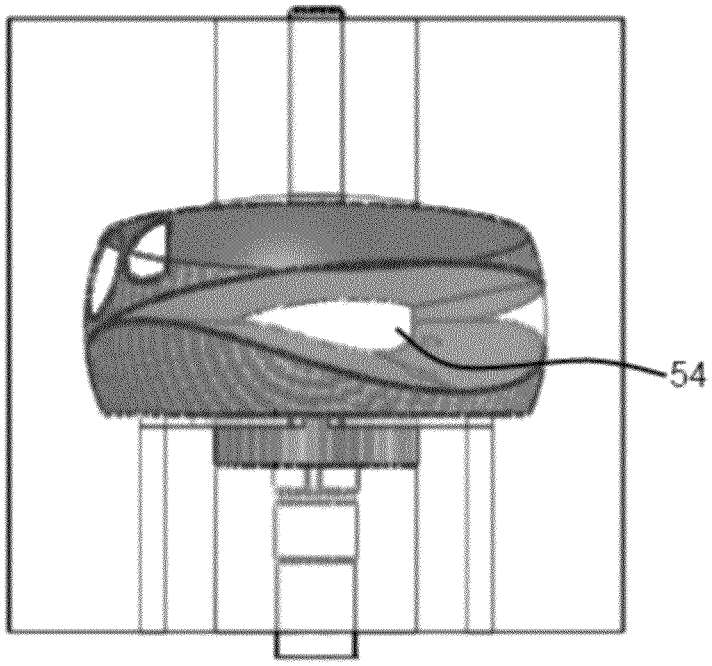
FIG. 4 is a front view of one embodiment of the disclosure in a second position with a portion of the housing removed to show the rotors and shaft.
Figure 5:
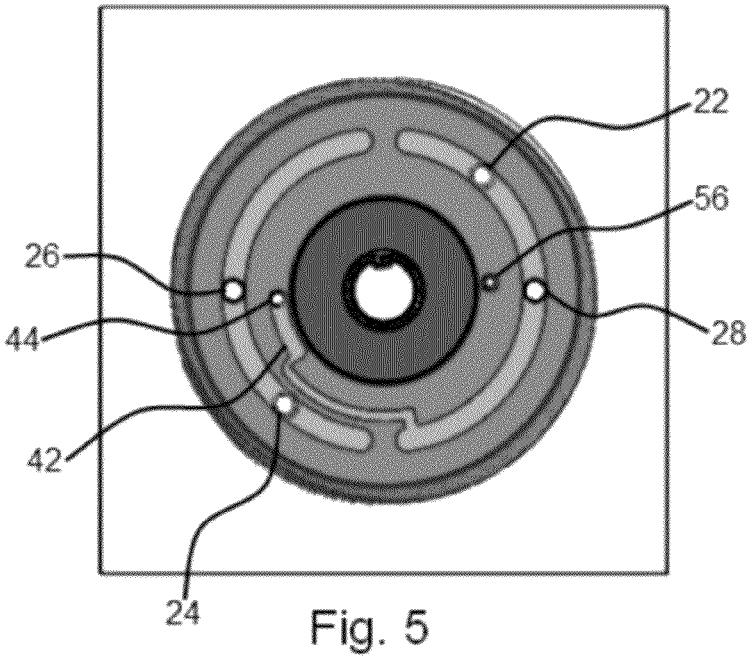
FIG. 5 is a top cutaway view of the embodiment shown in FIG. 4.
Figure 6:
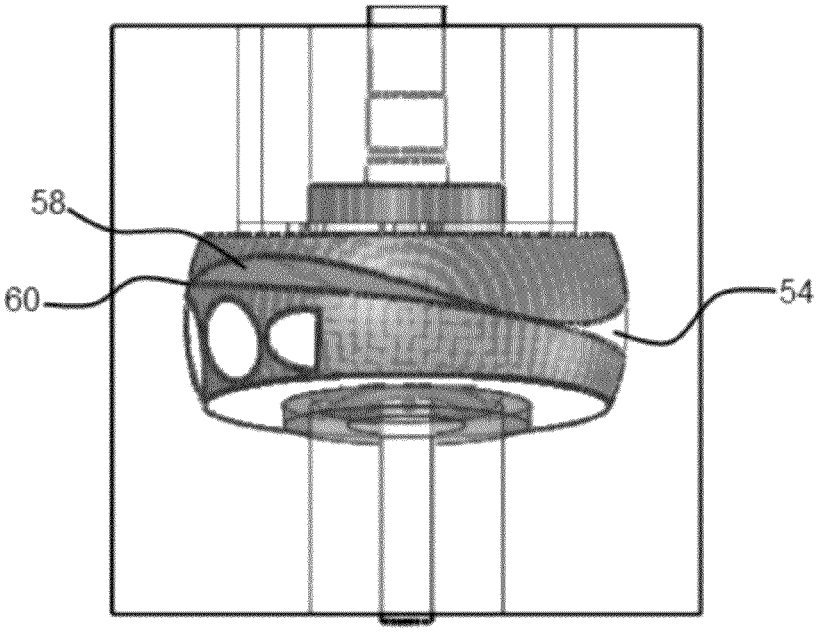
FIG. 6 is a rear view of the embodiment shown in FIG. 4 flipped top to bottom to show the opposing side.

Looking to the second stage shown in FIGS. 4-6, the volume at 54 continues to compress as the pump rotates and the region at 58 continues to expand. At the same time, the recirculated volume at 60 is shown collapsed substantially to zero. The port 44 is connected to the secondary channel 42, and the port 56 is not connected to any channel.

Figure 7:
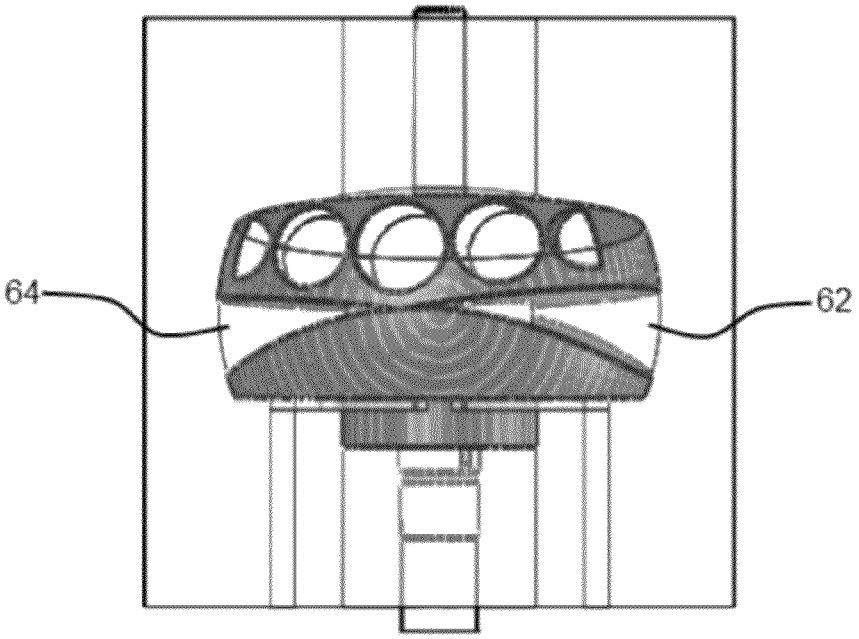
FIG. 7 is a front view of one embodiment of the disclosure in a first position with a portion of the housing removed to show the rotors and shaft.
Figure 8:
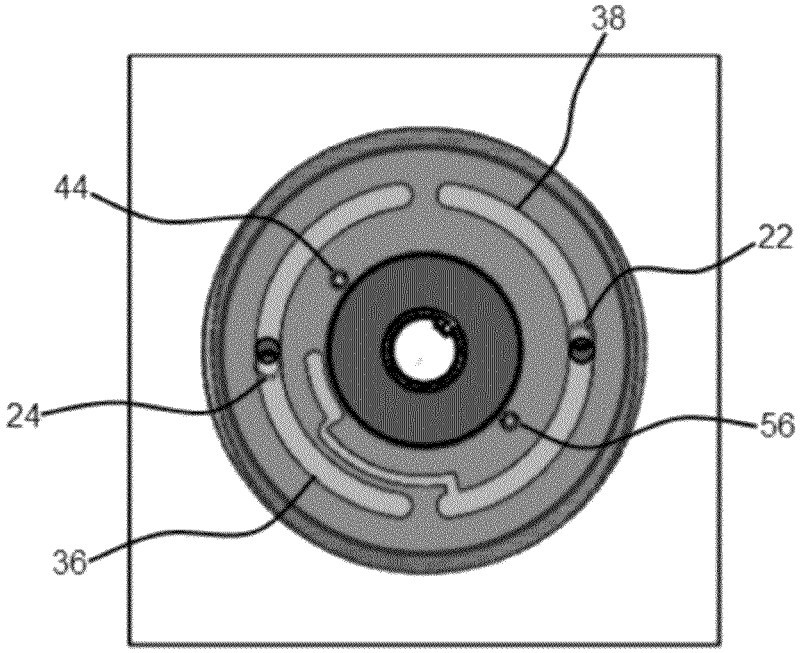
FIG. 8 is a top cutaway view of the embodiment shown in FIG. 1.
Figure 9:
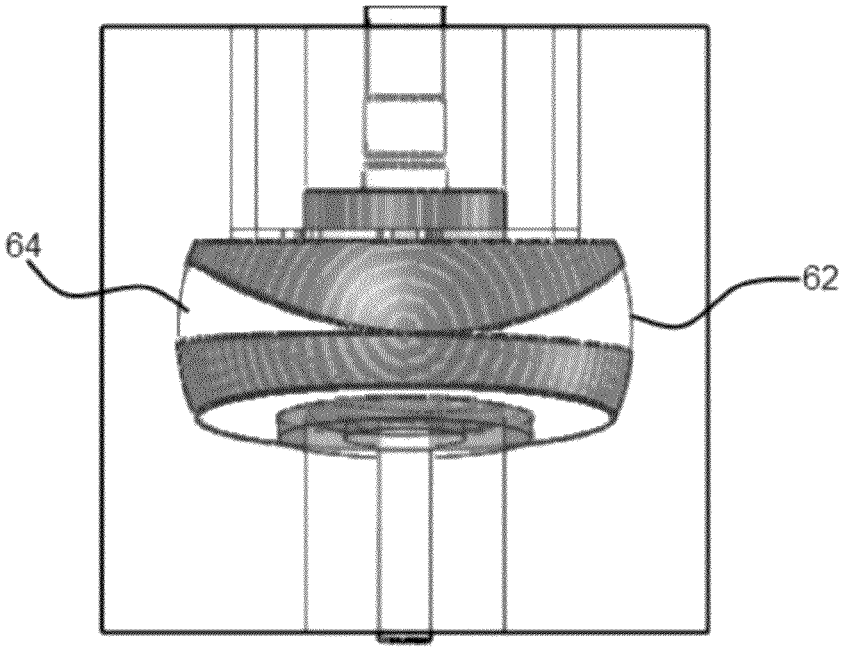
FIG. 9 is a rear view of the embodiment shown in FIG. 1 flipped top to bottom to show the opposing side.

Looking to FIGS. 7-9, the area at 62 continues to compress as the pump rotates, and the area at 64 continues to expand. Both ports 56 and 44 are not coupled to any channel, and the ports 22 and 24 are connected to the inlet/outlet channels 38 and 36.

Figure 10:
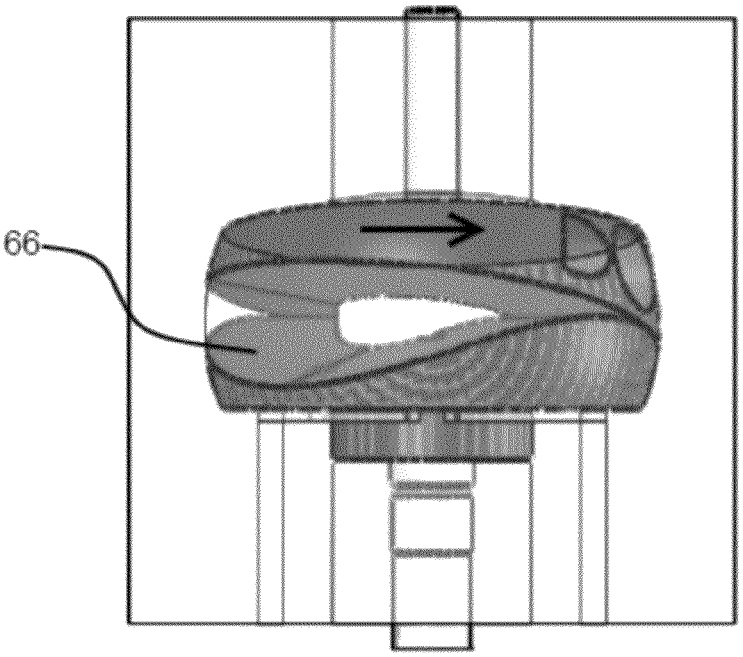
FIG. 10 is a front view of one embodiment of the disclosure in a third position with a portion of the housing removed to show the rotors and shaft.
Figure 11:
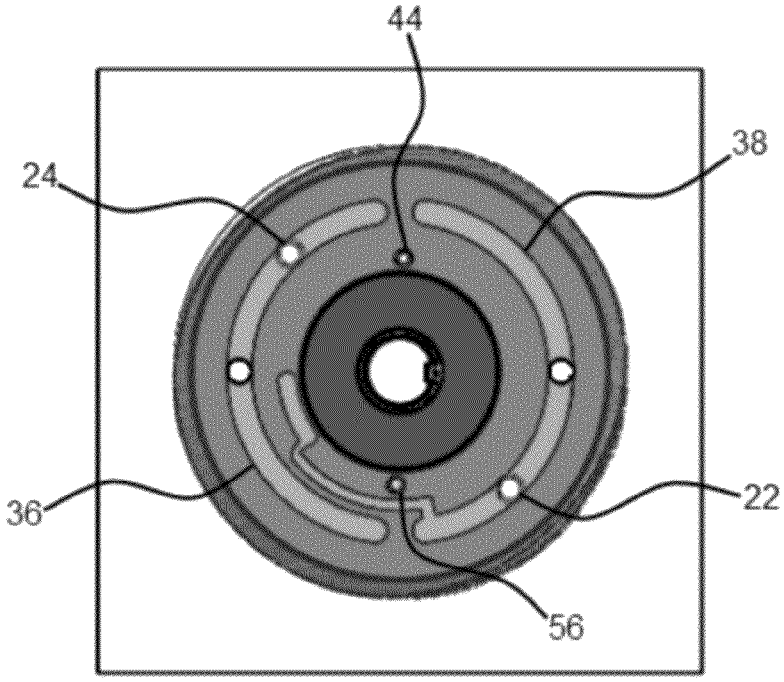
FIG. 11 is a top cutaway view of the embodiment shown in FIG. 10.
Figure 12:
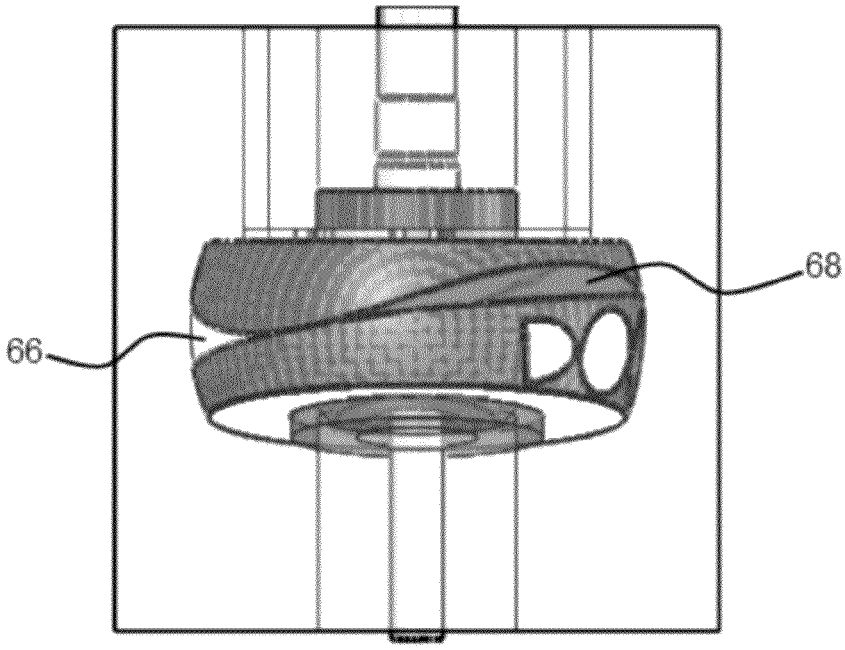
FIG. 12 is a rear view of the embodiment shown in FIG. 10 flipped top to bottom to show the opposing side.

FIGS. 10-12 show the next stage as the area at 66 continues to expand, and the area at 68 continues to compress as the pump rotates. The ports 22 and 24 are still connected to the channels 38 and 36. Meanwhile, the ports 44 and 56 are not connected to any channel.

Figure 13:
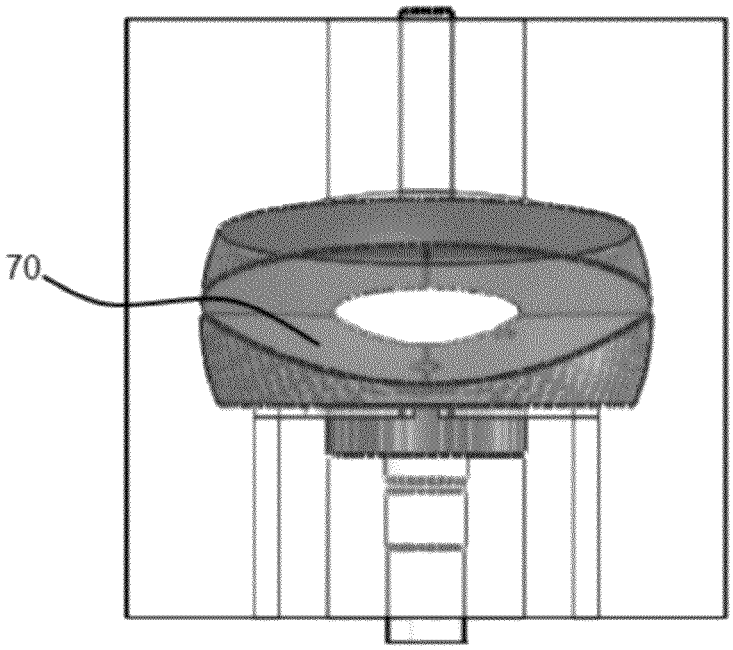
FIG. 13 is a front view of one embodiment of the disclosure in a fourth position with a portion of the housing removed to show the rotors and shaft.
Figure 14:
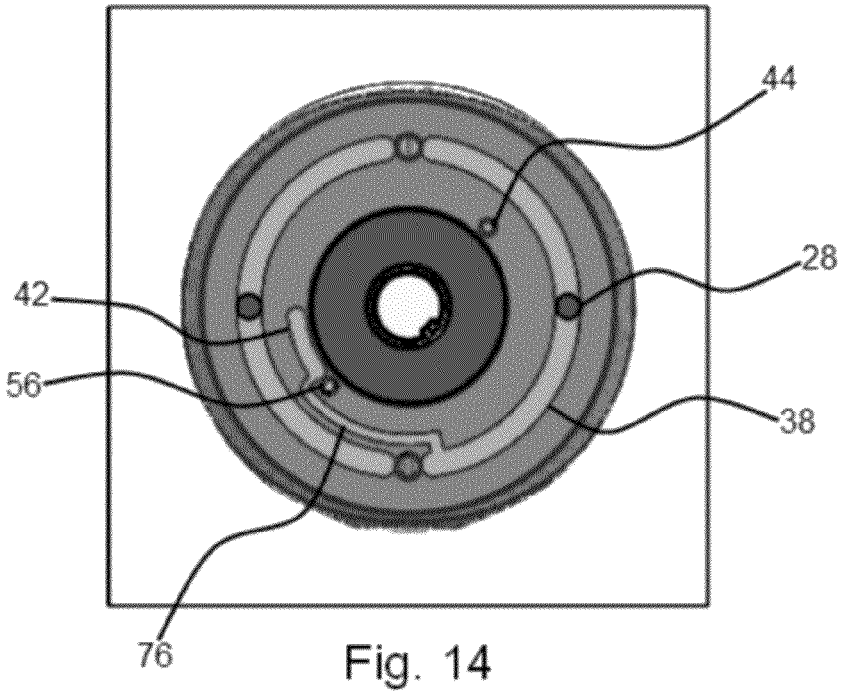
FIG. 14 is a top cutaway view of the embodiment shown in FIG. 13.
Figure 15:
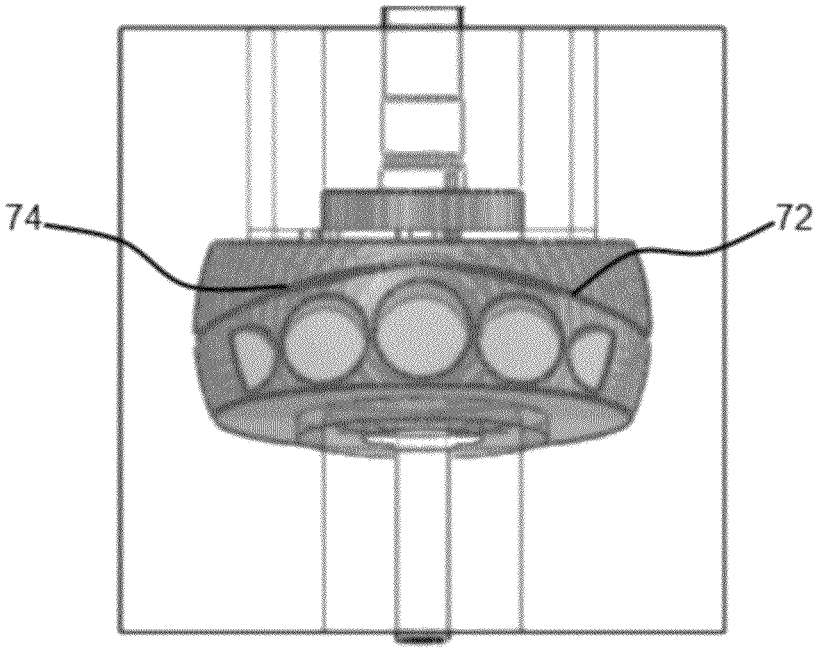
FIG. 15 is a rear view of the embodiment shown in FIG. 13 flipped top to bottom to show the opposing side.

FIGS. 13-15 show the last stage in a single rotation, where the region at 70 is fully expanded, and the area at 72 is about to expand when the pump rotates slightly. The region at 74 or "recirculated volume" is pinched off. Thus, the port at 56 allows venting of the region 74 through the secondary channel 42 and the sub-channel 76 to the primary channel 38 which in turn is connected to the outlet 28. Following this stage, the pump rotates to the first stage shown in FIGS. 1-3 and the cycle begins again.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore we claim:

1. A rotary pump comprising:

a. a first rotor comprising a back side, and a front side comprising at least one lobe wherein the number of lobes is N;

b. a second rotor comprising a back side, and a front side comprising at least two buckets and at least one lobe, and wherein the number lobes is N±1 resulting in the rotational speed of the first rotor being unequal to the rotational speed of the second rotor;

c. wherein the front side of the first rotor is in contact with the front side of the second rotor and operatively configure to rotate relative thereto;

d. a housing encompassing the first and second rotors;

e. a shaft operatively configured to rotate relative to the housing;

f. a first port extending from the front side of the second rotor at each bucket to the back side of the second rotor;

g. at least two primary channels provided adjacent the back side of the second rotor and in fluid communication with the first port at specific regions as the second rotor rotates relative to the housing;

h. an inlet port provided in the housing, in fluid communication with one of the primary channels; and i. an outlet port provided in the housing, in fluid communication with one of the primary channels other than the primary channel in fluid communication with the inlet port.

2. A rotary pump comprising:

a. a first rotor comprising a back side, and a front side comprising at least one lobe;

b. a second rotor comprising a back side, and a front side comprising at least two buckets;

c. wherein the front side of the first rotor is in contact with the front side of the second rotor and operatively configure to rotate relative thereto;

d. a housing encompassing the first and second rotors;

e. a shaft operatively configured to rotate relative to the housing;

f. a first port extending from the front side of the second rotor at each bucket to the back side of the second rotor;

g. at least two primary channels provided adjacent the back side of the second rotor and in fluid communication with the first port at specific regions as the second rotor rotates relative to the housing;

h. an inlet port provided in the housing, in fluid communication with one of the primary channels; and i. an outlet port provided in the housing, in fluid communication with one of the primary channels other than the primary channel in fluid communication with the inlet port;

j. a secondary port extending from the front side of the second rotor at each bucket to the back side of the second rotor angularly and radially offset from the first port in communication with the associated bucket;

k. a secondary channel provided adjacent the back side of the second rotor and in fluid communication with the secondary port at specific regions as the second rotor rotates relative to the housing; and l. wherein the secondary channel is in fluid communication with the outlet port.

3. The rotary pump as recited in claim 2 wherein at least one of the rotors comprises at least one surface defining a void formed in the outer circumference operatively configured to balance the rotor and wherein the surface defining the void is not in fluid communication with the lobes at any point in the rotation of the rotary pump.

4. The rotary pump as recited in claim 2 wherein:

a. the first rotor rotates in a first direction at a first rotational speed;

b. the second rotor rotates in the first direction at a second rotational speed which is different than the first rotational speed.

5. The rotary pump as recited in claim 4 wherein the speed ratio of the second rotor relative to the first rotor is n1/n2 where n1 is the number of lobes on the first rotor and n2 is the number of lobes on the second rotor.

* * * * *